US009273643B2

(12) United States Patent
Carlson et al.

(10) Patent No.: US 9,273,643 B2
(45) Date of Patent: Mar. 1, 2016

(54) CONTROL OF MANIFOLD VACUUM IN SKIP FIRE OPERATION

(71) Applicant: Tula Technology, Inc., San Jose, CA (US)

(72) Inventors: Steven E. Carlson, Oakland, CA (US); Xin Yuan, Palo Alto, CA (US); Joshua P. Switkes, Menlo Park, CA (US); Louis J. Serrano, Los Gatos, CA (US)

(73) Assignee: Tula Technology, Inc., San Jose, CA (US)

( * ) Notice: Subject to any disclaimer, the term of this patent is extended or adjusted under 35 U.S.C. 154(b) by 273 days.

(21) Appl. No.: 13/961,701

(22) Filed: Aug. 7, 2013

(65) Prior Publication Data

US 2014/0041641 A1 Feb. 13, 2014

Related U.S. Application Data

(60) Provisional application No. 61/682,168, filed on Aug. 10, 2012.

(51) Int. Cl.

| | |
|---|---|
| ***F02M 25/08*** | (2006.01) |
| ***F02M 35/10*** | (2006.01) |
| ***F02D 41/00*** | (2006.01) |

(Continued)

(52) U.S. Cl.

CPC ..... *F02M 25/08* (2013.01); *F02D 41/0087* (2013.01); *F02M 25/089* (2013.01); *F02M 35/10222* (2013.01); *F02M 35/10229* (2013.01); *F02D 17/02* (2013.01); *F02D 29/02* (2013.01); *F02D 41/003* (2013.01); *F02D 2009/024* (2013.01); *F02D 2250/08* (2013.01); *F02D 2250/41* (2013.01)

(58) Field of Classification Search

CPC ..... F02M 35/10229; F02M 35/1022; F02M 25/08; F02D 41/0087

USPC ..... 123/520, 516, 518, 519, 572, 481, 123/198 F, 332, 325; 701/112

See application file for complete search history.

(56) References Cited

U.S. PATENT DOCUMENTS 4,062,334 A * 12/1977 Toda et al. ..... 123/547
4,434,767 A 3/1984 Kohama et al.

(Continued)

FOREIGN PATENT DOCUMENTS

CN 1924345 3/2007
CN 102162401 8/2011

OTHER PUBLICATIONS

International Search Report dated Nov. 1, 2013 from International Application No. PCT/US2013/054194.

(Continued)

*Primary Examiner* — Mahmoud Gimie
(74) *Attorney, Agent, or Firm* — Beyer Law Group LLP

(57) ABSTRACT

A variety of methods and arrangements are described for selectively reducing intake manifold pressure in a skip fire engine control system. In some embodiments, a throttle is adjusted to generate a manifold vacuum, which is used for various applications, including but not limited to purging a fuel vapor canister, reducing pressure within a brake vacuum booster reservoir and/or venting gas from a crankcase interior. An engine firing fraction is increased to help maintain a desired torque level. Other techniques for reducing the intake manifold pressure are also described, such as applications involving a return to idle.

23 Claims, 5 Drawing Sheets

(51) Int. Cl.

| | |
|---|---|
| *F02D 17/02* | (2006.01) |
| *F02D 29/02* | (2006.01) |
| *F02D 9/02* | (2006.01) |

(56) References Cited

U.S. PATENT DOCUMENTS

| | | | | |
|---|---|---|---|---|
| 4,489,695 | A | 12/1984 | Kohama et al. | |
| 4,509,488 | A | 4/1985 | Forster et al. | |
| 4,592,315 | A * | 6/1986 | Kobayashi et al. | 123/308 |
| 4,945,869 | A * | 8/1990 | Klomp | 123/73 V |
| 5,377,631 | A | 1/1995 | Schechter | |
| 6,158,411 | A | 12/2000 | Morikawa | |
| 6,532,944 | B1 | 3/2003 | Leone et al. | |
| 6,619,258 | B2 | 9/2003 | McKay et al. | |
| 6,718,937 | B2 | 4/2004 | Kim | |
| 6,735,938 | B2 | 5/2004 | Surnilla | |
| 6,866,020 | B2 | 3/2005 | Allston et al. | |
| 6,978,204 | B2 | 12/2005 | Surnilla et al. | |
| 7,000,602 | B2 | 2/2006 | Cullen et al. | |
| 7,032,572 | B2 | 4/2006 | Bidner et al. | |
| 7,063,062 | B2 | 6/2006 | Lewis et al. | |
| 7,086,386 | B2 | 8/2006 | Doering | |
| 7,128,044 | B1 | 10/2006 | Doering et al. | |
| 7,464,674 | B2 | 12/2008 | Michelini et al. | |
| 7,503,312 | B2 | 3/2009 | Surnilla et al. | |
| 7,577,511 | B1 | 8/2009 | Tripathi et al. | |
| 7,762,241 | B2 | 7/2010 | Childress et al. | |
| 7,849,835 | B2 | 12/2010 | Tripathi et al. | |
| 7,886,715 | B2 | 2/2011 | Tripathi et al. | |
| 7,930,087 | B2 | 4/2011 | Gibson et al. | |
| 7,941,994 | B2 | 5/2011 | Surnilla et al. | |
| 7,954,474 | B2 | 6/2011 | Tripathi et al. | |
| 8,047,961 | B2 * | 11/2011 | Jess et al. | 477/101 |
| 8,099,224 | B2 | 1/2012 | Tripathi et al. | |
| 8,131,445 | B2 | 3/2012 | Tripathi et al. | |
| 8,131,447 | B2 | 3/2012 | Tripathi et al. | |
| 2001/0011456 | A1 * | 8/2001 | Hagen et al. | 60/397 |
| 2002/0195087 | A1 * | 12/2002 | Dunsworth et al. | 123/481 |
| 2003/0131820 | A1 * | 7/2003 | Mckay et al. | 123/198 F |
| 2003/0230280 | A1 | 12/2003 | Allston et al. | |
| 2008/0066450 | A1 | 3/2008 | Surnilla et al. | |
| 2008/0173284 | A1 | 7/2008 | Kavanagh et al. | |
| 2010/0012086 | A1 * | 1/2010 | Demura | 123/399 |
| 2010/0012099 | A1 | 1/2010 | Kerns et al. | |
| 2010/0043744 | A1 * | 2/2010 | Suzuki et al. | 123/260 |
| 2010/0050993 | A1 | 3/2010 | Zhao et al. | |
| 2010/0263636 | A1 | 10/2010 | Kerns et al. | |
| 2011/0083639 | A1 * | 4/2011 | Gallon et al. | 123/321 |
| 2011/0202262 | A1 | 8/2011 | Gibson et al. | |
| 2011/0208405 | A1 | 8/2011 | Tripathi et al. | |
| 2011/0213540 | A1 | 9/2011 | Tripathi et al. | |
| 2011/0251773 | A1 | 10/2011 | Sahandiesfanjani et al. | |
| 2012/0138005 | A1 | 6/2012 | White et al. | |

OTHER PUBLICATIONS

Written Opinion dated Nov. 1, 2013 from International Application No. PCT/US2013/054194.

Chinese Office Action dated Jul. 27, 2015 from Chinese Application No. 201380041434.X.

* cited by examiner

| Deceleration rate/ engine speed | 1000 RPM | 1500 RPM | 2000 RPM |
|---|---|---|---|
| 1000 RPM/sec | 8 | 6 | 2 |
| 500 RPM/sec | 4 | 2 | 0 |
| 250 RPM/sec | 2 | 0 | 0 |
| 0 RPM/sec | 0 | 0 | 0 |

CONTROL OF MANIFOLD VACUUM IN SKIP FIRE OPERATION

CROSS REFERENCE TO RELATED APPLICATIONS

This application claims priority of U.S. Provisional Patent Application No. 61/682,168, entitled "Control of Manifold Vacuum in Skip Fire Operation," filed Aug. 10, 2012, which is hereby incorporated by reference in its entirety for all purposes.

FIELD OF THE INVENTION

The present invention relates generally to controlling manifold absolute pressure for use with skip fire operation of an internal combustion engine. Various embodiments relate to systems for purging fuel vapor, a crankcase ventilation system and power braking applications.

BACKGROUND

In most conventional internal combustion engines, the intake manifold(s) is/are the volume(s) between the throttle(s) and working chamber intake ports. Air flows through the intake manifold from the ambient environment to the working chambers. When a driver depresses the accelerator pedal, a throttle valve is opened to allow more air into the intake manifold. The resulting increase in the manifold absolute pressure (MAP) causes more air to enter the working chambers and increases engine output.

Since a conventional vehicle is frequently operating at much less than full throttle, the MAP tends to be much lower than atmospheric pressure (i.e., for engines that are not boosted). In other words, there tends to be a substantial vacuum in the intake manifold. This vacuum can be used for a variety of other purposes, as will be described in more detail below in connection with FIG. 1.

FIG. 1 illustrates an internal combustion engine that includes a crankcase 167, a cylinder 161, a piston 163, an intake manifold 165 and an exhaust manifold 169. The fuel tank 151 is connected via a line to a fuel vapor canister 155, which in turn is connected to the intake manifold 165. A brake vacuum booster reservoir 157 is also connected to the intake manifold. The throttle valve 171 controls the inflow of air from an air filter or other air source into the intake manifold.

The fuel in fuel tank 151 is volatile and generates fuel vapor that, for environmental reasons, should not be released into the ambient environment. As a result, the vehicle includes a fuel vapor canister 155 that contains a suitable absorber material 153 (such as charcoal) for capturing the fuel vapor. A vacuum vapor line 154 connects the fuel vapor canister 155 to the intake manifold 165 through a fuel vapor canister valve 156. When the fuel vapor canister valve 156 is open vacuum within the intake manifold 165 is used to draw the fuel vapor through the vapor line 154 into the intake manifold 165. From the intake manifold, the fuel vapor passes into the working chambers of the engine, where it is combusted and passed through the exhaust manifold 169 to the catalytic converter.

It is also desirable to remove vapor that collects in the crankcase 167. During the operation of the engine, gases (both burned and unburned) leak from the cylinders into the crankcase past the piston rings (not shown in FIG. 1). These gases must be vented to avoid pressure buildup in the crankcase. For environmental reasons it is desirable if these gases are vented through the intake manifold into the cylinders, since the gases may contain combustion byproduct and hydrocarbons. The gases may be vented into the intake manifold using the positive crankcase ventilation valve (PCV) 173 or directly in a crankcase ventilation (CCV) system. The PCV valve is a one way valve that only allows flow from the crankcase 167 into the intake manifold 165. Vacuum in the intake manifold is helpful to remove these noxious gases from the crankcase.

Power braking systems also make use of a vacuum in the intake manifold 165. More specifically, the brake vacuum booster reservoir 157 is a canister that includes a diaphragm. When the driver presses the brake pedal, air is allowed to enter on one side of the diaphragm. There is a vacuum in a low pressure region on the other side of the diaphragm, which is maintained through a connection 175 with the intake manifold. This pressure differential amplifies the force that is applied to the brake pedal and increases braking power.

SUMMARY

The present application involves methods and arrangements for selectively reducing intake manifold pressure in a skip fire engine control system. In one aspect of the invention, an engine is operated in a skip fire manner to generate a desired torque level using a throttle set at a substantially open position. The throttle is further closed to reduce the intake manifold pressure. The resulting manifold vacuum can be used for a variety of applications, including but not limited to purging a fuel vapor canister, reducing pressure within a brake vacuum booster reservoir, and/or venting gas from a crankcase interior. An engine firing fraction is increased to help maintain the desired torque level. Afterward, the throttle is returned to the substantially open position and the firing fraction is decreased.

In another aspect of the invention, the intake manifold pressure is reduced to prepare for a return to idle. A particular approach involves operating an engine in a skip fire manner to generate a desired torque level using a throttle set at a substantially open position. It is determined that the engine will return to idle (e.g., when the vehicle is coasting and decelerating.) The throttle is closed at least partially to help reduce the intake manifold pressure. The engine firing fraction is increased to help further reduce the intake manifold pressure. An engine parameter (e.g., TCC slip, cam or spark timing) is adjusted to help maintain the desired torque level, since the increase in the engine firing fraction generally contributes to an increase in torque output. In various embodiments, after the return to idle has been completed, the throttle is returned to the substantially open position.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

The present invention relates generally to methods and mechanisms for controlling manifold absolute pressure in conjunction with skip fire operation of an internal combustion engine.

Conventional operation of an internal combustion engine generally maintains a partial vacuum in the intake manifold. As previously discussed, this vacuum can be used to various purposes, including ventilating the crankcase, removing fuel vapor and assisting in power braking.

In skip fire operation, the manifold absolute pressure (MAP) tends to be closer to atmospheric pressure than in conventional engine control using a throttle. This is because skip fire operation generally involves firing selected working chambers during selected working cycles under optimized conditions i.e., conditions in which large amounts of air and fuel are delivered to the fired working chambers. Accordingly, in various implementations the throttle tends to be kept substantially open and the manifold absolute pressure is maintained at near atmospheric pressure, for example within 20% of atmospheric pressure.

The embodiments described herein describe methods and mechanisms for creating a vacuum in the intake manifold during skip fire operation. This vacuum can be dynamically generated to address any need that any system or component in the vehicle may have for a lower MAP. Such applications may include but are not limited to evaporative system purge control, power braking and crankcase ventilation.

Figure 2:
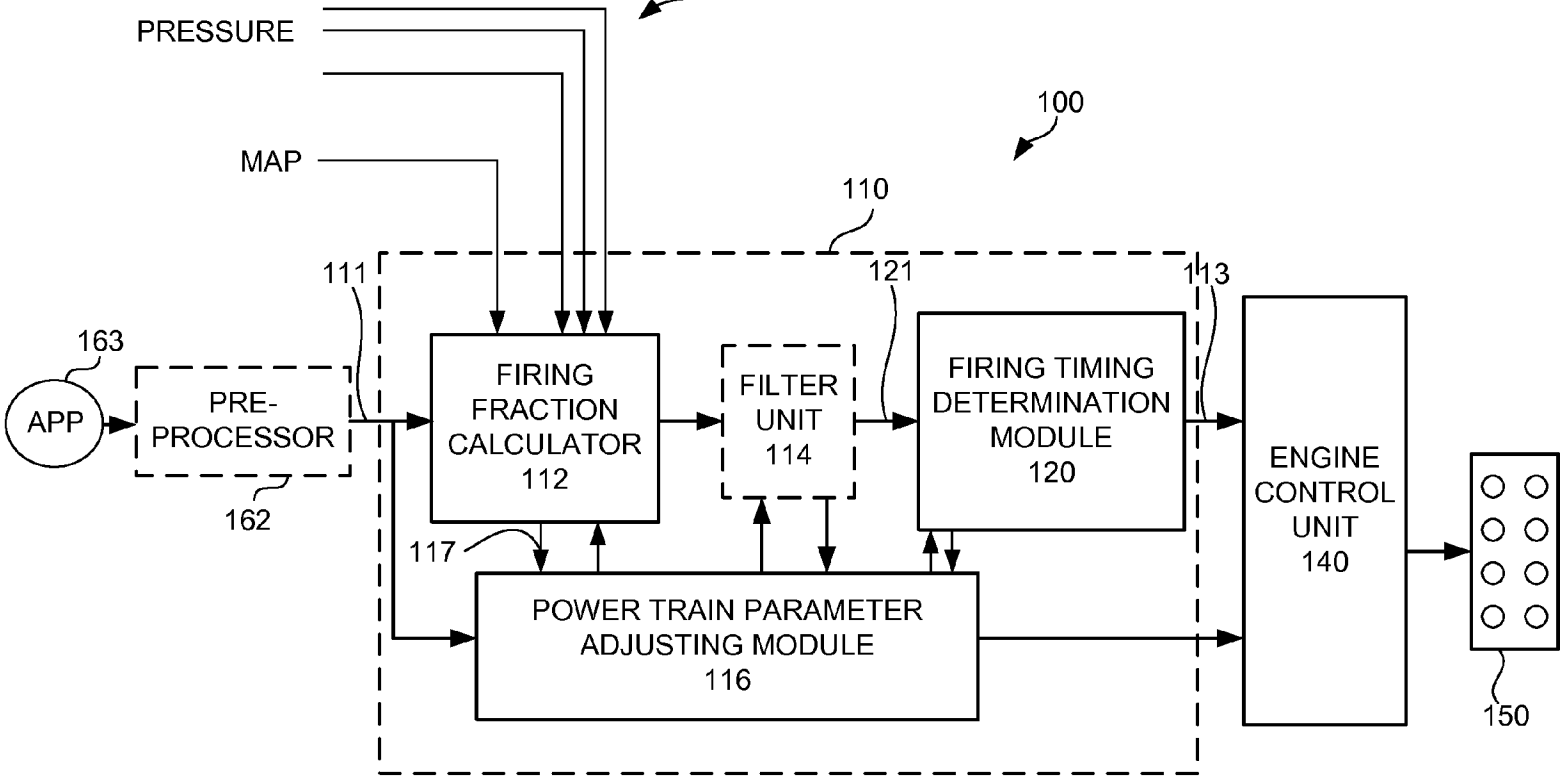
FIG. 2 is a skip fire engine controller with mechanisms for controlling the manifold absolute pressure according to one embodiment of the present invention.

Referring initially to FIG. 2, a skip fire engine controller 100 in accordance with one embodiment of the present invention will be described. The engine controller 100 includes a skip fire controller 110 arranged to work in conjunction with an engine control unit (ECU) 140. In other embodiments, the functionality of the skip fire controller 110 may be incorporated into the ECU 140. The illustrated skip fire controller 100 includes a firing fraction calculator 112, an optional filter unit 114, a power train parameter adjusting module 116, and a firing timing determining module 120. The skip fire controller 110 receives an input signal 111 indicative of a desired engine output and is arranged to generate a sequence of firing commands that cause an engine 150 to provide the desired output using a skip fire approach. The skip fire controller also receives input signals 119, which indicate absolute pressure levels in various components, such as the intake manifold, fuel tank, brake vacuum reservoir and/or crankcase.

In the embodiment of FIG. 2, the input signal 111 is treated as a request for a desired engine output. The signal 111 may be received or derived from an accelerator pedal position sensor (APP) 163 or other suitable sources, such as a cruise controller, a torque controller, etc. In FIG. 2 an optional preprocessor 162 may modify the accelerator pedal signal prior to delivery to the skip fire controller 110. However, it should be appreciated that in other implementations, the accelerator pedal position sensor 163 may communicate directly with the skip fire controller 110.

Input signals 119 are received or derived from any suitable sources whose pressure levels or other parameters would influence a firing fraction calculation. By way of example, signals 119 may indicate the manifold absolute pressure (MAP), the crankcase pressure, the fuel tank vapor pressure and/or the pressure in the brake vacuum booster reservoir. Signals 119 may indicate a maximum allowable MAP or the barometric pressure.

The firing fraction calculator 112 receives input signals 111 and 119 and is arranged to determine a skip fire firing fraction that would be appropriate to deliver the desired output under selected engine operating conditions. The firing fraction is indicative of the percentage of firings under the current (or directed) operating conditions that are required to deliver the desired output. Under some conditions, the firing fraction may be determined based on the percentage of optimized firings that are required to deliver the driver requested engine torque (e.g., when the cylinders are firing at an operating point substantially optimized for fuel efficiency). In other circumstances, as will be described below, the firing fraction takes into account other variables, such as the MAP and the pressure levels indicated by signals 119.

Skip fire operation tends to work particularly well under substantially optimal conditions (thermodynamic or otherwise). For example, substantial improvements in fuel efficiency can be achieved if the mass air charge introduced to the working chambers for each of the cylinder firings is set at the mass air charge that provides substantially the highest thermodynamic efficiency at the current operating state of the engine (e.g., engine speed, environmental conditions, etc.). These types of conditions generally involve a high MAP (e.g., approximately 80% or above of the ambient atmospheric pressure). Under particular circumstances, however, a somewhat lower MAP may be desirable so that a partial vacuum or low pressure volume is formed in the intake manifold, which can be used for applications such as fuel vapor purge, crankcase ventilation, and power braking assist. To compensate for the lower MAP and to achieve the same level of engine output, the firing fraction is increased. This adjustment is generally temporary, and optimal firing conditions may be restored once the aims of the adjustment are met.

One application that requires a lower MAP relates to the removal of fuel vapor from the fuel vapor canister. In a particular implementation, one of the input signals 119 provides information on the fuel tank vapor pressure. A high fuel tank pressure (i.e., that exceeds a particular threshold) indicates that fuel vapor needs to be delivered out of the fuel vapor canister and into the intake manifold and the engine. In this situation, the firing fraction calculator 112 determines that a lower MAP is required to transfer fuel vapor into the intake manifold. The firing fraction calculator then sends a signal 117 to the power train parameter adjusting module 116 indicating that the MAP should be decreased to a particular target level. Additionally, relative to a situation in which the MAP was not adjusted, a corresponding higher firing fraction will be calculated so that the desired engine output is still achieved.

A variety of other conditions may trigger a decrease in the MAP and a corresponding increase in the firing fraction. For example, the input signals 119 may indicate the barometric pressure or a maximum allowable MAP. At higher altitudes, there is a limit as to how high the MAP can go, which means that a higher firing fraction may be required to generate the same level of torque. In some designs, input signals 119 indicate brake booster pressure and/or crankcase pressure. If the brake booster pressure or the crankcase pressure rises above a particular threshold, the firing fraction calculator will similarly take action to increase the firing fraction and decrease the MAP. These operations are discussed in greater detail below in connection with FIG. 3.

The required decreases in the MAP and corresponding increases in the firing fraction will vary widely, depending on the needs of a particular application. For example, in some implementations, fuel vapor can be adequately dissipated if the MAP is reduced approximately 0.15-0.35 atm. The adjusted MAP and firing fraction may be maintained for as long as 40-60% of the time that the engine is operated in a skip fire mode. Some implementations involve the adjusted MAP and firing fraction being maintained for up to a maximum of 60% of that time. In other designs, however, the period of adjustment can be much shorter or longer. Generally, the MAP and firing fractions are adjusted as appropriate as long as the pressure levels indicated by input signals 119 indicate a need for a substantial vacuum in the intake manifold. When the input signals 119 indicate that pressure levels have reached acceptable levels, the adjustment of the MAP and the firing fraction may be ended and normal skip fire operation and MAP levels may be resumed.

In the illustrated embodiment, a power train parameter adjusting module 116 is provided that cooperates with the firing fraction calculator 112. The power train parameter adjusting module 116 directs the ECU 140 to set selected power train parameters appropriately to insure that the actual engine output substantially equals the requested engine output at the commanded firing fraction. By way of example, if the power train parameter adjusting module 116 receives an input signal 117 indicating that a decrease in the MAP is desirable, the module 116 may direct the ECU to achieve the decrease by further closing the throttle. Of course, in some embodiments, the power train parameter adjusting module 116 may be arranged to directly control various engine settings.

The firing timing determining module 120 is arranged to issue a sequence of firing commands (e.g., drive pulse signal 113) that cause the engine to deliver the percentage of firings dictated by a commanded firing fraction 121. The firing timing determining module 120 may take a wide variety of different forms. For example, in some embodiments, the firing timing determining module 120 utilizes various types of lookup tables to implement the desired control algorithms. In other embodiments, a sigma delta converter or other mechanisms are used. The sequence of firing commands (sometimes referred to as a drive pulse signal 113) outputted by the firing timing determining module 120 may be passed to an engine control unit (ECU) or combustion controller 140 which orchestrates the actual firings.

In the embodiment illustrated in FIG. 2, the output of the firing fraction calculator 112 is optionally passed through a filter unit 114 before it is delivered to the firing timing determining module 120. The filter unit 114 is arranged to mitigate the effect of any step change in the commanded firing fraction such that the change in firing fraction is spread over a longer period. This "spreading" or delay can help smooth transitions between different commanded firing fractions and can also be used to help compensate for mechanical delays in changing the engine parameters.

The firing fraction calculator 112, the filter unit 114, and the power train parameter adjusting module 116 may take a wide variety of different forms and their functionalities may alternatively be incorporated into an ECU, or provided by other more integrated components, by groups of subcomponents or using a wide variety of alternative approaches. By way of example, some suitable firing fraction calculators, firing timing determining modules, filter units, and power train parameter adjusting modules are described in co-assigned U.S. Pat. Nos. 7,954,474; 7,886,715; 7,849,835; 7,577,511; 8,099,224; 8,131,445; and 8,131,447; U.S. patent application Ser. Nos. 13/004,839 and 13/004,844; and U.S. Provisional Patent Application Nos. 61/080,192; 61/682,065; 61/104,222; and 61/640,646, each of which is incorporated herein by reference in its entirety for all purposes. In various alternative implementations, these functional blocks may be accomplished algorithmically using a microprocessor, ECU or other computation device, using analog or digital components, using programmable logic, using combinations of the foregoing and/or in any other suitable manner.

Figure 1:
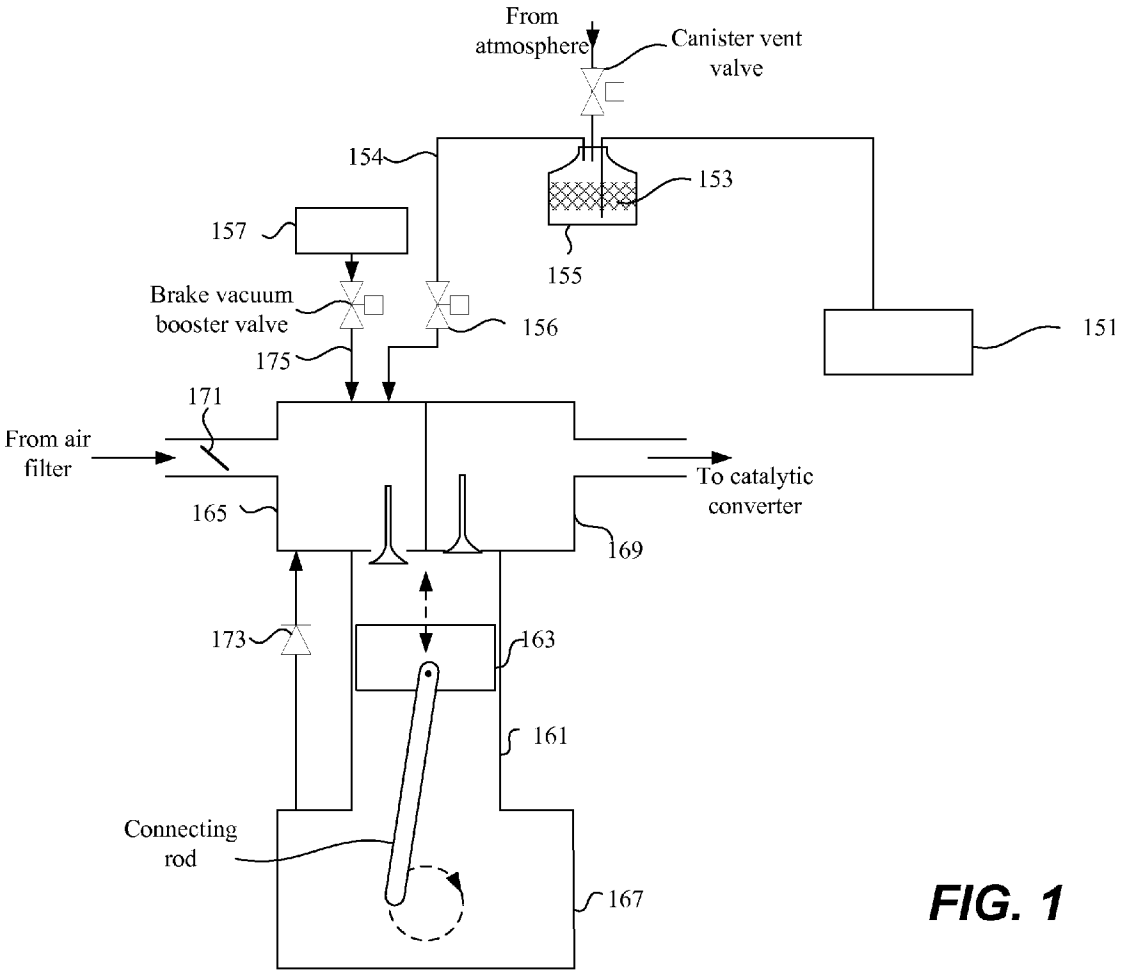
FIG. 1 is a diagram of an internal combustion engine, a brake vacuum reservoir booster, fuel tank and fuel vapor canister.
Figure 3:
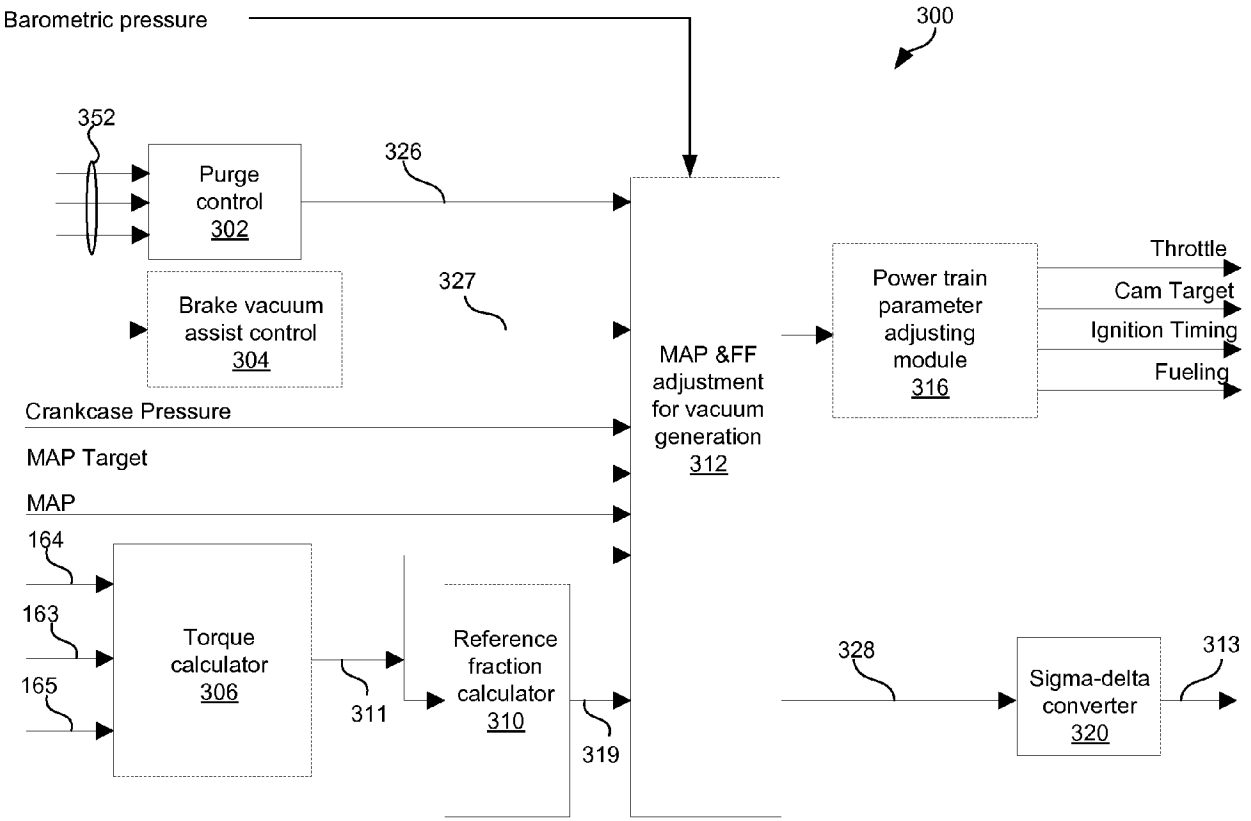
FIG. 3 is a skip fire engine controller according to another embodiment of the present invention.

Referring next to FIG. 3, a skip fire controller 300 according to one embodiment of the present invention will be described. The skip fire engine controller 300 includes a purge control 302, a brake vacuum assist control 304, a torque calculator 306, a MAP and firing fraction (FF) adjustment calculator 312, a power train parameter adjusting module 316 and a sigma delta converter 320. The purge control 302 determines whether action needs to be taken to remove fuel vapor from the fuel vapor canister. The purge control 302 receives a plurality of input signals 352 indicative of the state of the fuel vapor canister 155 and fuel tank 151 (FIG. 1). These input signals may include a measure of fuel tank vapor pressure. They may also include readings from oxygen sensors in the exhaust gas. The oxygen sensors may be used to determine the presence of purge-related, rich-mixture in the exhaust manifold, if the fuel vapor canister valve 156 (FIG. 1) is open. Fuel vapor from an open fuel vapor canister valve 156 (FIG. 1) can enter the engine through the intake manifold, be at least partially combusted in a normal firing process, and exit into the exhaust manifold where the air-fuel ratio from the combusted mixture can be read with an oxygen sensor. The oxygen sensors may be used to provide feedback to the evaporative system by determining the amount of excess fuel (some of which may be from purge vapor) in the exhaust manifold. A decision can then be made if the fuel vapor canister valve 156 (FIG. 1) is to remain open or if the control initiates closing the valve to bring the overall air-fuel ratio within desired limits.

The oxygen sensors may be used to determine the presence of fuel vapor into the exhaust manifold if the fuel vapor canister valve 156 (FIG. 1) is open. The input signals may also include various timing and temperature signals that initiate purge of the fuel vapor canister after a certain duration of engine operation or operating temperature is reached. If any of these input signals exceeds a particular level, a commanded purge signal 326 is sent. The commanded purge signal 326 indicates that MAP and firing fraction adjustments are desirable to help remove trapped fuel vapor from the fuel vapor canister 155 (FIG. 1). One or more values may also be sent to help determine how much adjustment is appropriate.

The brake vacuum assist control 304 behaves in a somewhat similar manner. That is, the brake vacuum assist control 304 is arranged to determine whether action needs to be taken to decrease the pressure in the brake vacuum booster reservoir 157 (FIG. 1). The brake vacuum assist control 304 receives an input signal indicative of the pressure in the brake vacuum booster reservoir. If this pressure rises above a particular level, a commanded brake vacuum signal 327 is sent to the MAP and firing fraction adjustment calculator 312. This signal indicates that corresponding MAP and firing fraction adjustments are desirable. The brake vacuum assist control may also send one or more values to calculator 312 to help determine the amount of adjustment.

The torque calculator 306 determines the requested torque or engine output signal 311. In the illustrated embodiment, the calculator receives an input signal that may be received or derived from an accelerator pedal position sensor (APP) 163, engine speed (RPM) sensor 164, vehicle speed sensor or other suitable source 165 (e.g., an ECU.) The requested engine output may also be based on factors in addition to, or instead of the accelerator pedal position. For example, in some embodiments, it may be desirable to account for the energy required to drive engine accessories, such as an air conditioner, alternators/generator, power steering pump, water pumps, vacuum pumps and/or any combination of these and other components. Appropriate determination of these accessory losses may be accomplished by the torque calculator 306, the ECU or other suitable components. In this example, the torque calculator 306 determines the requested engine torque based on the received inputs and transmits it to a reference firing fraction calculator 310 and the MAP and firing fraction adjustment calculator 312. The reference firing fraction calculator 310 determines the firing fraction in the absence of any requirements to reduce MAP. It generates a reference firing fraction signal 319, which is fed into the MAP and firing fraction adjustment calculator 312. While the reference firing fraction calculator 310 and MAP and firing fraction adjustment calculator 312 are shown as separate modules in FIG. 3 they may be combined or arranged in different ways in alternative embodiments.

The MAP and firing fraction adjustment calculator 312 may also receive an input signal indicative of the MAP. The calculator may receive other input signals from any other suitable source that should influence the adjustment of MAP and the firing fraction. In the illustrated embodiment, for example, the calculator 312 also monitors the crankcase pressure to help determine if crankcase ventilation and a corresponding reduction in the MAP is necessary. Also shown are signals indicative of the target MAP level and the barometric pressure.

The MAP and firing fraction adjustment calculator 312 determine whether adjustments to the MAP and firing fraction are appropriate in light of the above input signals and conditions. The calculator 312 also determines the amount of MAP reduction and the corresponding increase in the firing fraction. The MAP and firing fraction adjustment calculator 312 may be integrated into or be the same as the firing fraction calculator 112 of FIG. 2.

In the illustrated embodiment, there are three events that can trigger adjustments to the MAP and firing fractions, although in other implementations there may be fewer or more such triggering events. For example, if the fuel tank vapor pressure is high (i.e., exceeds a predetermined threshold) or the fuel vapor canister 155 needs to be purged, the purge control 302 will send a signal to the calculator 312 indicating that a corresponding MAP and firing fraction adjustment are desirable. Also, a rise in the brake booster pressure can indicate that the vacuum in the brake booster vacuum reservoir is inadequate and that a lower MAP is required. If the brake booster pressure rises above a particular predetermined level, the brake vacuum assist control 304 will send a signal to the calculator 312 requesting suitable MAP/firing fraction adjustments. A high crankcase pressure level can indicate that there is an undesirable level of vapor buildup in the crankcase due to leaks from the working chambers. Accordingly, if the crankcase pressure exceeds a particular threshold, the calculator 312 will determine how large, respectively, the reduction and increase in the MAP and firing fraction should be.

The process for adjusting the MAP and firing fraction can vary widely, depending on the needs of a particular application. In the illustrated embodiment, for example, the purge control 302 and brake vacuum assist control 304 are separate from the calculator 312 and make independent determinations regarding whether MAP/firing fraction adjustments are desirable. These decisions and corresponding values or pressure levels are then sent to the calculator 312. In other embodiments, the fuel tank vapor pressure and brake booster pressure may be transmitted directly to the calculator 312. Some implementations involve a preliminary calculation of a reference firing fraction 319 i.e., the firing fraction that would suitable for achieving the requested torque under substantially optimal conditions, without consideration of adjustments based on pressure levels in the crankcase, fuel tank or brake vacuum booster reservoir. The calculator then determines a new, higher firing fraction based on the above considerations. In other designs, the adjusted firing fraction is determined without calculating the reference firing fraction e.g., by taking into account the actual (not nominal) MAP. In various embodiments, the above firing fraction calculations are performed for different target MAPs (e.g., for different altitudes) using distinct lookup tables.

Afterward, the calculator 312 sends a request to the power train parameter adjusting module 316, which may be the same as power train parameter adjustment module 116 of FIG. 2. In response to the request, the module 316 directs the ECU to set one or more engine settings so that the desired MAP reduction is achieved. For example, the module 316 may further close the throttle to increase the vacuum in the intake manifold. The module 316 may be arranged to adjust a wide variety of other engine settings (e.g., valve timing, ignition timing, fuel delivery, etc.) to achieve the desired MAP level.

The MAP and firing fraction adjustment calculator 312 also sends the adjusted firing fraction 328 to the sigma delta converter 320 which may be identical to the firing timing determination module 120 of FIG. 2. The sigma delta converter 320 determines a sequence of firing commands that cause the engine to deliver the percentage of firings dictated by the adjusted firing fraction 328. An advantage of using a sigma delta converter is that it translates an input into a digital output that on average matches the input. Accordingly, the adjusted firing fraction can be converted into a drive pulse signal 313, which is then outputted to the ECU and used to operate the working chambers of the engine.

Figure 4:
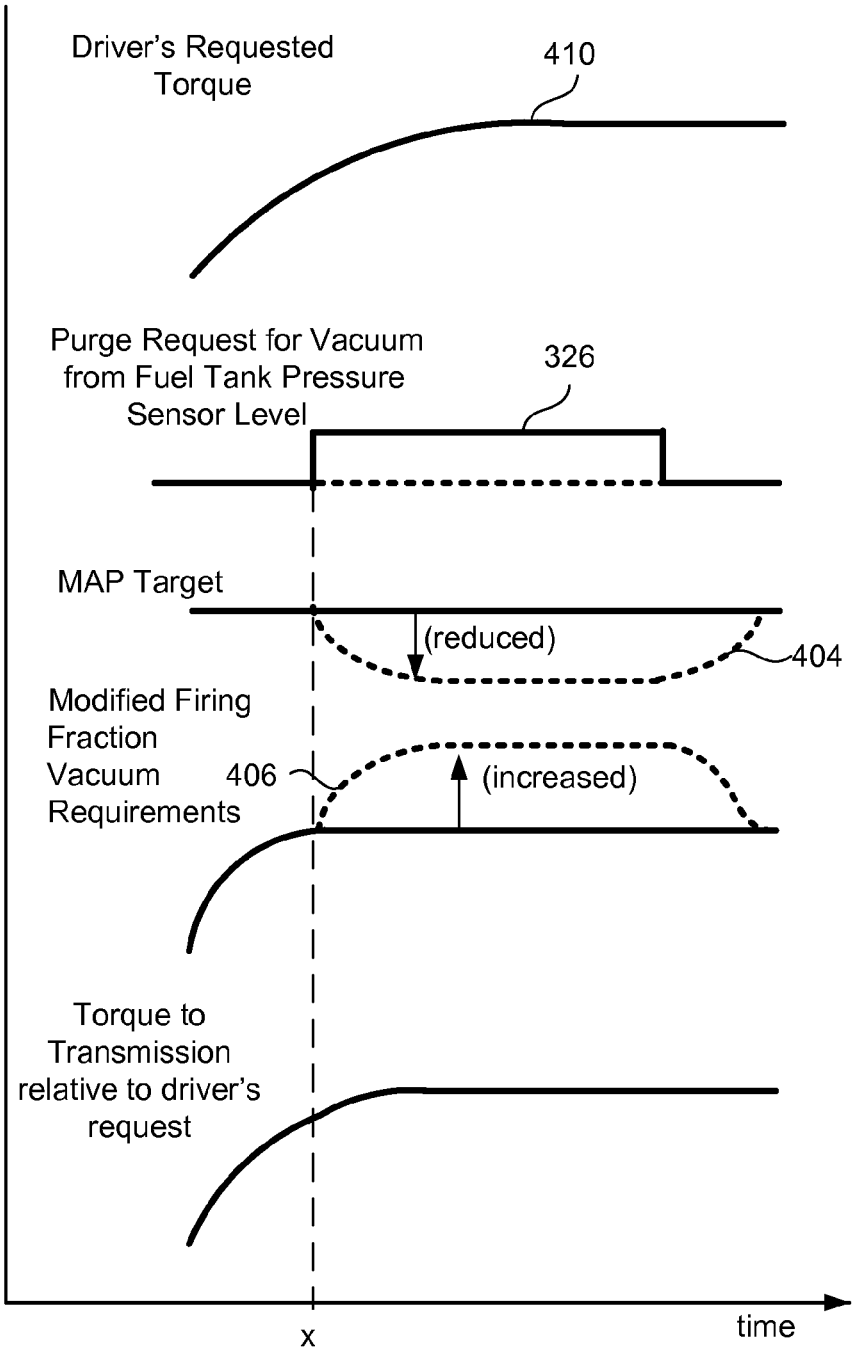
FIG. 4 is a graph illustrating the timing of a representative purge request.

Referring next to FIG. 4, a graph illustrating the timing of a representative purge request will be described. In the illustrated embodiment curve 410 represents the requested torque, a commanded purge signal 326 indicates at time X that the fuel tank pressure sensor level has reached a designated threshold and that a purge of the fuel vapor canister is required. Accordingly, as seen in curve 404, the MAP is reduced from what it would have been had the purge request not been taken in consideration, as indicated by the difference between the dotted and solid curves. The firing fraction is increased to compensate for the loss in torque resulting from the reduction in the MAP (curve 406). Due to the adjustment in the firing fraction, the actual torque (curve 408) generally matches the requested torque (curve 410), despite the drop in the MAP. It should be appreciated that the graph is intended to be general and diagrammatic, and only illustrates one example implementation. Other approaches may involve different triggering events and/or timing patterns.

Figures 5, 6:
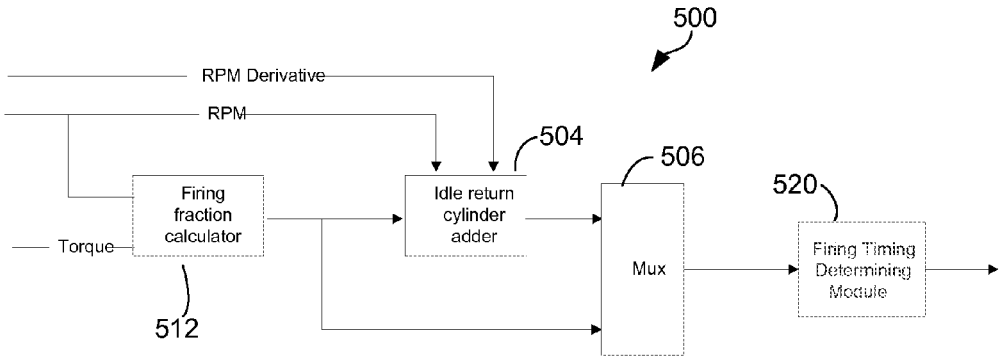
FIG. 5 is a flow diagram illustrating a method for generating vacuum during fast deceleration according to one embodiment of the present invention.
FIG. 6 is a chart with example numbers indicating changes in the number of added cylinders based on the deceleration rate.

Referring next to FIG. 5, an engine controller 500 according to another embodiment of the present invention will be described. The illustrated engine controller may be a skip fire engine controller (e.g., similar to skip fire engine controller 100 of FIG. 2) or an engine braking controller, examples of which are described in U.S. Provisional Patent Applications Nos. 61/677,888 (referred to hereinafter as the '888 application) and 61/683,553 (referred to hereinafter as the '553 application), each of which is incorporated herein in its entirety for all purposes. The engine controller 500 is arranged to smooth the transition between fast deceleration/stop and a resumption of acceleration.

When coasting and decelerating, some vehicles will enter a mode called deceleration fuel cut off (DFCO.) In this mode, no fuel is delivered to the working chambers. In an engine without valve deactivation capability air is pumped through the working chambers. In engines where at least some of the valves can be deactivated, such as those described within, the valves on any given working chamber may be deactivated during DFCO or they may remain in operation. In the first case, neither air nor fuel is delivered to the working chambers, while in the second case, some air still enters the working chambers.) When all of the working chambers are deactivated for a period of time, no air is delivered from the intake manifold into the working chambers and air continues to flow into the intake manifold through the throttle valve, even if the throttle valve is mostly closed. As a result, the MAP tends to equalize with atmospheric pressure. When a driver again presses down on the gas pedal, the transition between deceleration/stop and acceleration can be somewhat abrupt, because the high MAP causes large amounts of air to be delivered into the fired working chambers. This abruptness may be somewhat more apparent in skip fire engine control systems.

The engine controller 500 is arranged to address the above issue. Generally, it does this by firing or delivering air (in the '888 application referred to as "braking mode") to selected working chambers during selected working cycles. This draws air from the intake manifold and reduces the MAP. The engine controller 500 includes a firing fraction calculator 512, an idle return cylinder adder 504, a multiplexer 506 and a firing fraction timing determining module 520. (It should be appreciated that while this description refers to the firing of cylinders, the present invention also contemplates approaches where those same cylinders are not fired but instead placed in a braking mode, as discussed in the '888 and '553 applications.)

The firing fraction calculator 512 may include the same functions as the firing fraction calculator 112 of FIG. 2. It is arranged to determine a skip firing fraction suitable for generating the desired torque or engine output. The firing fraction is provided to the multiplexer 506 and the idle return cylinder adder 504.

The idle return cylinder adder 504 determines how many additional working chambers should be fired (i.e., how the firing fraction should be adjusted) to help reduce the MAP to an appropriate level. In the illustrated embodiment, the idle return cylinder adder 504 receives as input the engine speed (RPM) and deceleration rate (RPM derivative), and may also use vehicle speed, coolant temperature, transmission gear, a MAP target, barometric pressure or other inputs. FIG. 6 illustrates an example of how the number of added working chambers could be determined based on the engine speed and the deceleration rate. As indicated in FIG. 6, the number of working chambers to be fired increases as the deceleration rate increases and the engine speed decreases. In the case of an abrupt, "panic" stop, more working chambers may need to be activated or fired to accelerate the reduction in the MAP. The idle return cylinder adder 504 outputs an adjusted firing fraction to the multiplexer 506. FIG. 6 is based on an 8-cylinder, 4-stroke engine. For different engine types the values shown in FIG. 6 may be adjusted as appropriate for the engine type.

The multiplexer 506 receives inputs indicating both the adjusted firing fraction (from idle return cylinder adder 504) and the unadjusted firing fraction (from the firing fraction calculator 512.) Under different conditions e.g., based on the brake pedal position, it may be desirable to select one firing fraction over the other. The selected firing fraction is then transmitted to the firing timing determining module 520. The module 520, which may be similar to or identical to the firing timing determining module 120 of FIG. 2, is arranged to delivered the percentage of firings dictated by the received firing fraction. In some embodiments, the module 520 includes a sigma delta converter.

When the firing fraction is increased to reduce the MAP, the torque generated by the working chambers may also increase. During deceleration, an increase in torque is undesirable. In various embodiments, the spark and/or cam timing may be adjusted to reduce torque output and cancel out the torque generated through the firing fraction increase.

Any and all of the described components may be arranged to refresh their determinations/calculations very rapidly. In some preferred embodiments, these determinations/calculations are refreshed on a working cycle by working cycle basis although, that is not a requirement. An advantage of the working cycle by working cycle operation of the various components is that it makes the controller very responsive to changed inputs and/or conditions. Although working cycle by working cycle operation is very effective, it should be appreciated that the various components (and especially the components before the firing timing determining module 120) can be refreshed more slowly while still providing good control (as for example by refreshing every revolution of the crankshaft, etc.).

In many preferred implementations the firing timing determining module 120 (or equivalent functionality) makes a discrete firing decision on a working cycle by working cycle basis. This does not mean that the decision is necessarily made at the same time as the actual firing. Thus, the firing decisions are typically made contemporaneously, but not necessarily synchronously, with the firing events. That is, a firing decision may be made immediately preceding or substantially coincident with the firing opportunity working cycle, or it may be made one or more working cycles prior to the actual working cycle. Furthermore, although many implementations independently make the firing decision for each working chamber firing opportunity, in other implementations it may be desirable to make multiple (e.g., two or more) decisions at the same time.

Some engines may be equipped with various subsystems that influence the amount of engine firing. For example, the engine may have a turbocharger with variable air paths, variable length intake runners, or variable exhaust paths. All of these subsystems can be incorporated as different elements in this invention.

The invention has been described primarily in the context of controlling the firing of 4-stroke piston engines suitable for use in motor vehicles. However, it should be appreciated that the described skip fire approaches are very well suited for use in a wide variety of internal combustion engines. These include engines for virtually any type of vehicle—including cars, trucks, boats, aircraft, motorcycles, scooters, etc.; and virtually any other application that involves the firing of working chambers and utilizes an internal combustion engine. The various described approaches work with engines that operate under a wide variety of different thermodynamic cycles—including virtually any type of two stroke piston engines, diesel engines, Otto cycle engines, Dual cycle engines, Miller cycle engines, Atkins cycle engines, Wankel engines and other types of rotary engines, mixed cycle engines (such as dual Otto and diesel engines), hybrid engines, radial engines, etc. It is also believed that the described approaches will work well with newly developed internal combustion engines regardless of whether they operate utilizing currently known, or later developed thermodynamic cycles.

The described skip fire engine controller may be implemented within an engine control unit. In some applications it will be desirable to provide skip fire control as an additional operational mode to a more conventional mode of operation. This allows the engine to be operated in a conventional mode when desired.

Most of the skip fire controller embodiments described above utilizes sigma delta conversion. Although it is believed that sigma delta converters are very well suited for use in this application, it should be appreciated that the converters may employ a wide variety of modulation schemes. For example, pulse width modulation, pulse height modulation, CDMA oriented modulation or other modulation schemes may be used to deliver the drive pulse signal. Some of the described embodiments utilize first order converters. However, in other embodiments higher order converters may be used.

Although only a few embodiments of the invention have been described in detail, it should be appreciated that the invention may be implemented in many other forms without departing from the spirit or scope of the invention. For example, although FIGS. 2 and 3 illustrate flow diagrams indicating how the MAP/firing fraction adjustments may take place, it should be appreciated that the adjustments can be achieved using any suitable process, including ones with different modules, steps and orders of operation. Therefore, the present embodiments should be considered illustrative and not restrictive and the invention is not to be limited to the details given herein.

What is claimed is:

1. A method of selectively reducing intake manifold pressure in a skip fire engine control system to help purge a fuel vapor canister, reduce pressure within a brake vacuum booster reservoir or vent gas from a crankcase interior, the method comprising:

operating an engine in a skip fire manner to generate a desired torque level using a throttle set at a substantially open position;

further closing the throttle to reduce the intake manifold pressure in order to perform a manifold vacuum-related process selected from the group consisting of 1) purging the fuel vapor canister; 2) reducing pressure within a brake vacuum booster reservoir; and 3) venting gas from the crankcase interior;

increasing an engine firing fraction to help maintain the desired torque level; and after the manifold vacuum-related process has been performed, returning the throttle to the substantially open position and decreasing the firing fraction.

2. A method as recited in claim 1 wherein the substantially open position of the throttle is arranged to keep the intake manifold pressure at a level greater than approximately 80% of the atmospheric pressure.

3. A method as recited in claim 1 further comprising:

detecting that a particular pressure level has exceeded a predetermined threshold, the pressure level being selected from the group consisting of a fuel tank pressure, a brake booster pressure and a crankcase pressure wherein the closing of the throttle is performed in response to the detection of the pressure level.

4. A method as recited in claim 1 wherein:

the setting of the throttle at the substantially open position helps to maintain the intake manifold pressure at a reference pressure level; and the closing of the throttle is performed to bring the intake manifold pressure approximately between 0.15 and 0.35 atm below the reference pressure level.

5. A method as recited in claim 1 wherein operating the engine in a skip fire manner involves deactivating at least one selected working cycle of at least one selected working chamber and firing at least one selected working cycle of at least one selected working chamber wherein individual working chambers are sometimes deactivated and sometimes fired.

6. A method as recited in claim 1 wherein:

the manifold vacuum-related process is selected from the group consisting of 1) purging the fuel vapor canister and 2) reducing pressure within the brake vacuum booster reservoir; and the method further comprises performing the manifold vacuum-related process.

7. A method as recited in claim 1 wherein the increasing of the firing fraction helps compensate for torque that would otherwise be lost due to the manifold vacuum-related process.

8. A method of selectively reducing intake manifold pressure in a skip fire engine control system to prepare for a return to idle, the method comprising:

operating an engine of a vehicle in a skip fire manner to generate a desired torque level using a throttle set at a substantially open position;

detecting that the engine will return to idle;

closing the throttle to help reduce the intake manifold pressure;

increasing an engine firing fraction to help reduce the intake manifold pressure; and adjusting an engine parameter to help maintain the desired torque level.

9. A method as recited in claim 8 wherein the adjusted engine parameter is one of the group selected from cam timing, TCC slip and spark timing.

10. A method as recited in claim 8 wherein:

the increasing of the engine firing fraction contributes to an increase in engine torque output; and the adjusting of the engine parameter contributes to a decrease in engine torque output, thereby helping to cancel out torque generated by the firing fraction increase and causing the delivered engine torque level to substantially match the desired engine torque level.

11. A method as recited in claim 8 wherein the desired torque level involves setting the throttle at the substantially open position such that the intake manifold pressure is greater than approximately 80% of the atmospheric pressure.

12. A method as recited in claim 8 wherein operating the engine in a skip fire manner involves deactivating at least one selected working cycle of at least one selected working chamber and firing at least one selected working cycle of at least one selected working chamber wherein individual working chambers are sometimes deactivated and sometimes fired.

13. A method as recited in claim 8 wherein the adjustment of the engine parameter helps compensate for torque change that would otherwise be caused by the increase in the firing fraction.

14. An engine controller used to control an internal combustion engine, the engine controller comprising:

a power train parameter adjusting module that is arranged to:

set the throttle at a substantially open position to help deliver a desired torque level;

further close the throttle to reduce the intake manifold pressure in order to perform a manifold vacuum-related process selected from the group consisting of 1) purging the fuel vapor canister; 2) reducing pressure within a brake vacuum booster reservoir; 3) venting gas from the crankcase interior; and 4) preparing for a return to idle; and return the throttle to the substantially open position after the manifold vacuum-related process has been at least substantially completed; and a firing fraction calculator that is arranged to:

generate a firing fraction that is used to operate working chambers of the engine in a skip fire manner and that helps deliver the desired torque level; and adjust the firing fraction in order to help perform the manifold vacuum-related process.

15. An engine controller as recited in claim 14 wherein:

the throttle is closed to prepare the engine for a return to idle; and the adjustment of the firing fraction involves increasing the firing fraction to help reduce the intake manifold pressure.

16. An engine controller as recited in claim 15 further comprising adjusting an engine parameter to help cancel out an engine torque output increase generated by the firing fraction increase.

17. An engine controller as recited in claim 16 wherein the adjusted engine parameter is selected from the group consisting of cam timing, TCC slip and spark timing.

18. An engine controller as recited in claim 14 wherein the power train parameter adjusting module is arranged to detect that a particular pressure level has exceeded a predetermined threshold, the pressure level being selected from the group consisting of a fuel tank pressure, a brake booster pressure and a crankcase pressure and wherein the closing of the throttle is performed in response to the detection of the pressure level.

19. An engine controller as recited in claim 14 wherein:

the setting of the throttle at the substantially open position is arranged to help maintain the intake manifold pressure at a reference pressure level;

the closing of the throttle is performed to bring the intake manifold pressure approximately between 0.15 and 0.35 atm below the reference pressure level.

20. An engine controller as recited in claim 14 further comprising:

a firing timing determination module that is arranged to generate a firing sequence based on the firing fraction wherein the firing sequence is used to operate working chambers of the engine in a skip fire manner.

21. A computer readable storage medium that includes executable computer code embodied in a tangible form operable to selectively reduce intake manifold pressure in a skip fire engine control system wherein the computer readable medium includes:

executable computer code for setting the throttle at a substantially open position to help deliver a desired torque level;

executable computer code for further closing the throttle to reduce the intake manifold pressure in order to perform a manifold vacuum-related process selected from the group consisting of 1) purging the fuel vapor canister; 2) reducing pressure within a brake vacuum booster reservoir; 3) venting gas from the crankcase interior; and 4) preparing for a return to idle;

executable computer code for returning the throttle to the substantially open position after the manifold vacuum-related process has been at least substantially completed; and executable computer code for generating a firing fraction that is used to operate working chambers of the engine in a skip fire manner and that helps deliver the desired torque level; and executable computer code for adjusting the firing fraction in order to help perform the manifold vacuum-related process.

22. A computer readable storage medium as recited in claim 21 further including executable computer code for adjusting an engine parameter to help cancel out an engine torque output increase generated by the firing fraction increase.

23. A computer readable storage medium as recited in claim 22 wherein the adjusted engine parameter is selected from the group consisting of cam timing, TCC slip and spark timing.

* * * * *